US011313189B2

(12) United States Patent
Dawsey et al.

(10) Patent No.: US 11,313,189 B2
(45) Date of Patent: Apr. 26, 2022

(54) DOWNHOLE CHECK VALVE ASSEMBLY WITH A FRUSTOCONICAL MANDREL

(71) Applicant: Halliburton Energy Services, Inc., Houston, TX (US)

(72) Inventors: Benny E. Dawsey, Houston, TX (US); Lonnie C. Helms, Humble, TX (US); Stephen A. Yeldell, Humble, TX (US); Min M. Yuan, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 124 days.

(21) Appl. No.: 16/961,494

(22) PCT Filed: Feb. 27, 2018

(86) PCT No.: PCT/US2018/020024
§ 371 (c)(1),
(2) Date: Jul. 10, 2020

(87) PCT Pub. No.: WO2019/168506
PCT Pub. Date: Sep. 6, 2019

(65) Prior Publication Data

US 2020/0340315 A1 Oct. 29, 2020

(51) Int. Cl.
*E21B 21/10* (2006.01)
*E21B 33/129* (2006.01)
(Continued)

(52) U.S. Cl.
CPC ..... *E21B 21/10* (2013.01); *E21B 23/01* (2013.01); *E21B 33/1293* (2013.01);
(Continued)

(58) Field of Classification Search
CPC ..... E21B 17/14; E21B 23/01; E21B 34/10; E21B 21/10; E21B 33/1293; E21B 33/14
See application file for complete search history.

(56) References Cited

U.S. PATENT DOCUMENTS 4,901,794 A * 2/1990 Baugh ..... E21B 23/01 166/118
5,379,835 A 1/1995 Streich
(Continued)

FOREIGN PATENT DOCUMENTS

WO 0120213 A1 3/2001

OTHER PUBLICATIONS

International Search Report and Written Opinion dated Nov. 27, 2018 for PCT Application No. PCT/US2018/020024 filed Feb. 27, 2018, pp. 18.

*Primary Examiner* — D. Andrews
(74) *Attorney, Agent, or Firm* — Chamberlain Hrdlicka

(57) ABSTRACT

Valve systems and methods for inserting into a casing used in a downhole environment are provided. The valve system includes a tool mandrel, a check valve assembly, and a setting system. The setting system includes inner and outer setting mandrels and a slip collar. The inner setting mandrel is located around at least a portion of the tool mandrel and includes a frustoconical outer surface. The outer setting mandrel is located around at least a portion of the inner setting mandrel and includes a frustoconical inner surface. The slip collar is located around at least a portion of the outer setting mandrel and includes a plurality of tabs and each tab includes gripping elements.

19 Claims, 5 Drawing Sheets

(51) Int. Cl.
*E21B 34/10* (2006.01)
*E21B 23/01* (2006.01)
*E21B 33/14* (2006.01)

(52) U.S. Cl.
CPC ..... *E21B 33/14* (2013.01); *E21B 34/10* (2013.01); *E21B 34/101* (2013.01)

(56) References Cited

U.S. PATENT DOCUMENTS

| | | | | |
|---|---|---|---|---|
| 6,581,681 | B1 | 6/2003 | Zimmerman et al. | |
| 7,128,154 | B2 | 10/2006 | Giroux et al. | |
| 8,336,616 | B1 | 12/2012 | McClinton | |
| 9,416,617 | B2 | 8/2016 | Wiese et al. | |
| 10,605,018 | B2 * | 3/2020 | Schmidt | E21B 23/01 |
| 2004/0251025 | A1 | 12/2004 | Giroux et al. | |
| 2008/0073086 | A1 | 3/2008 | Cook | |
| 2010/0139911 | A1 | 6/2010 | Stout | |
| 2013/0008671 | A1 | 1/2013 | Booth | |
| 2014/0224477 | A1 | 8/2014 | Wiese et al. | |
| 2015/0068728 | A1 | 3/2015 | Stage et al. | |
| 2015/0300122 | A1 | 10/2015 | George et al. | |
| 2017/0044859 | A1 | 2/2017 | Blair | |
| 2021/0062597 | A1 * | 3/2021 | Yuan | E21B 23/01 |
| 2021/0062611 | A1 * | 3/2021 | Yeldell | E21B 34/08 |

* cited by examiner

DOWNHOLE CHECK VALVE ASSEMBLY WITH A FRUSTOCONICAL MANDREL

BACKGROUND

This section is intended to provide relevant background information to facilitate a better understanding of the various aspects of the described embodiments. Accordingly, it should be understood that these statements are to be read in this light and not as admissions of prior art.

Check valves and other floating equipment can be installed above ground within a pipe or casing and used during downhole operations, such as for controlling fluid flow. The check valve is installed into a segment of pipe which is later connected to the casing. The valve is assembled into this segment via concrete, resin, or even threading. Problems may be caused during the downhole operation if a check valve becomes unattached or slips from within the casing.

Therefore, there is a need for a check valve assembly that reliably maintains a gas-tight seal with the inner surface of the casing under relatively high pressures commonly experienced during downhole operations.

BRIEF DESCRIPTION OF THE DRAWINGS

Embodiments of the invention are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Valve systems and methods for inserting the valve system into a casing used in a downhole environment are provided. The valve system includes a tool mandrel, a check or flapper valve assembly, and a setting system. The check valve assembly is coupled to the tool mandrel and operable to provide a fluid flow in a primary direction through a passageway of the tool mandrel and to prohibit the fluid flow in a secondary direction through the passageway opposite of the primary direction. The setting system includes an inner setting mandrel, an outer setting mandrel, and a slip collar. The inner setting mandrel is located on and around the tool mandrel and includes a cylindrical inner surface and a frustoconical outer surface. The outer setting mandrel is located on and around the inner setting mandrel and includes a frustoconical inner surface and a cylindrical outer surface.

The slip collar is located on and around the outer setting mandrel. The slip collar includes one or more sealing elements and a plurality of tabs including gripping elements.

Figure 1:
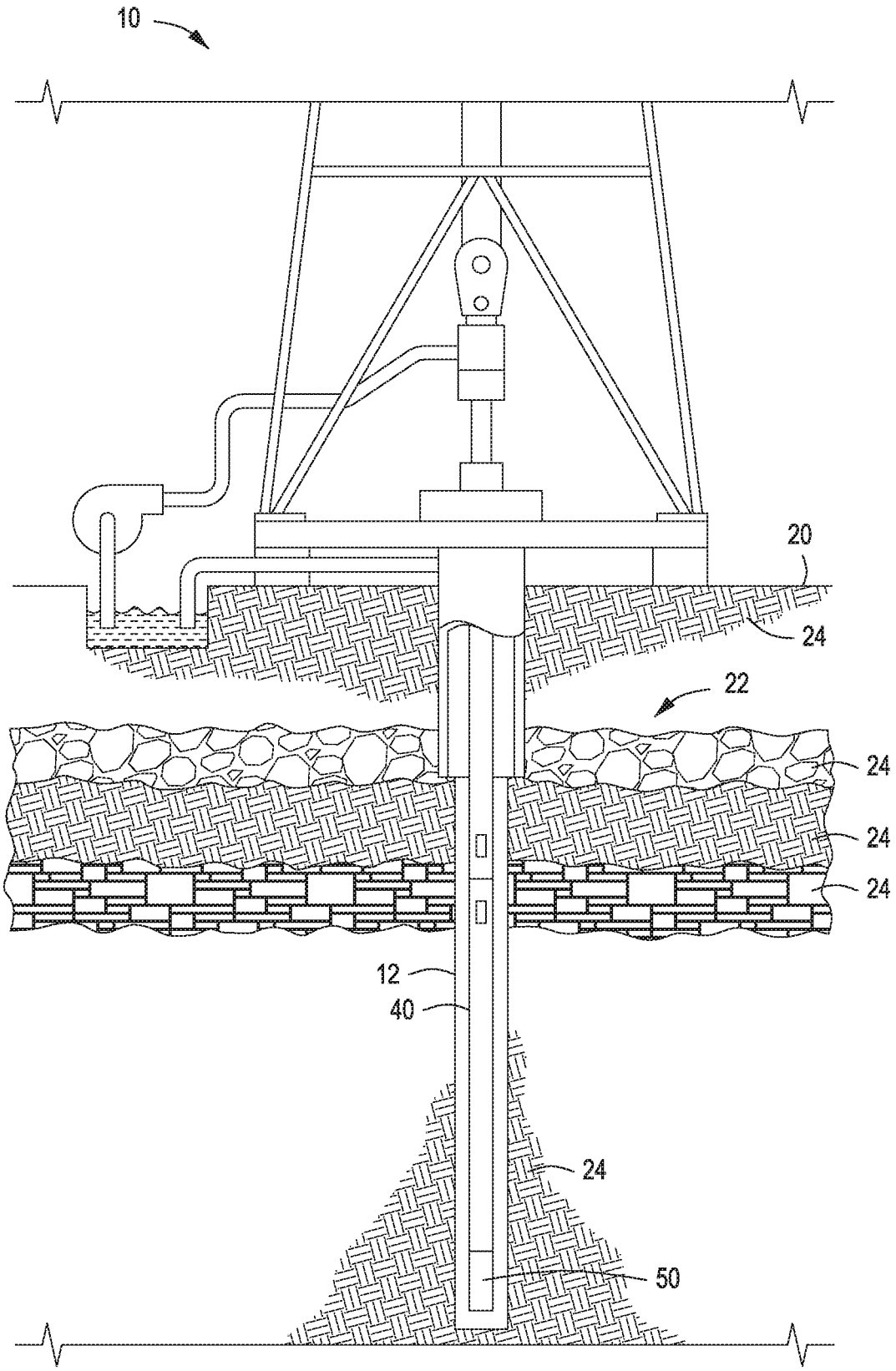
FIG. 1 depicts a schematic view of a well system containing a valve system located within a casing in a downhole environment, according to one or more embodiments.

FIG. 1 depicts a schematic view of a well system 10 including a valve system 50 that is located in a casing 40 placed into a downhole environment, including a subterranean region 22 beneath the ground surface 20, according to one or more embodiments. The valve system 50 can be a check valve, a flapper valve, or another type of valve or flow control device. A string of pipes connected together form the casing 40 that is lowered into a wellbore 12.

The subterranean region 22 includes all or part of one or more subterranean formations, subterranean zones, and/or other earth formations. The subterranean region 22 shown in FIG. 1, for example, includes multiple subsurface layers 24. The subsurface layers 24 can include sedimentary layers, rock layers, sand layers, or any combination thereof and other types of subsurface layers. One or more of the subsurface layers 24 can contain fluids, such as brine, oil, gas, or combinations thereof. The wellbore 12 penetrates through the subsurface layers 24 and although the wellbore 12 shown in FIG. 1 is a vertical wellbore, the valve system 50 can also be implemented in other wellbore orientations. For example, the valve system 50 may be adapted for horizontal wellbores, slant wellbores, curved wellbores, vertical wellbores, or any combination thereof. The valve system 50 can be or include any of the valve systems and/or the check valve assemblies described and discussed below.

Figure 2A:
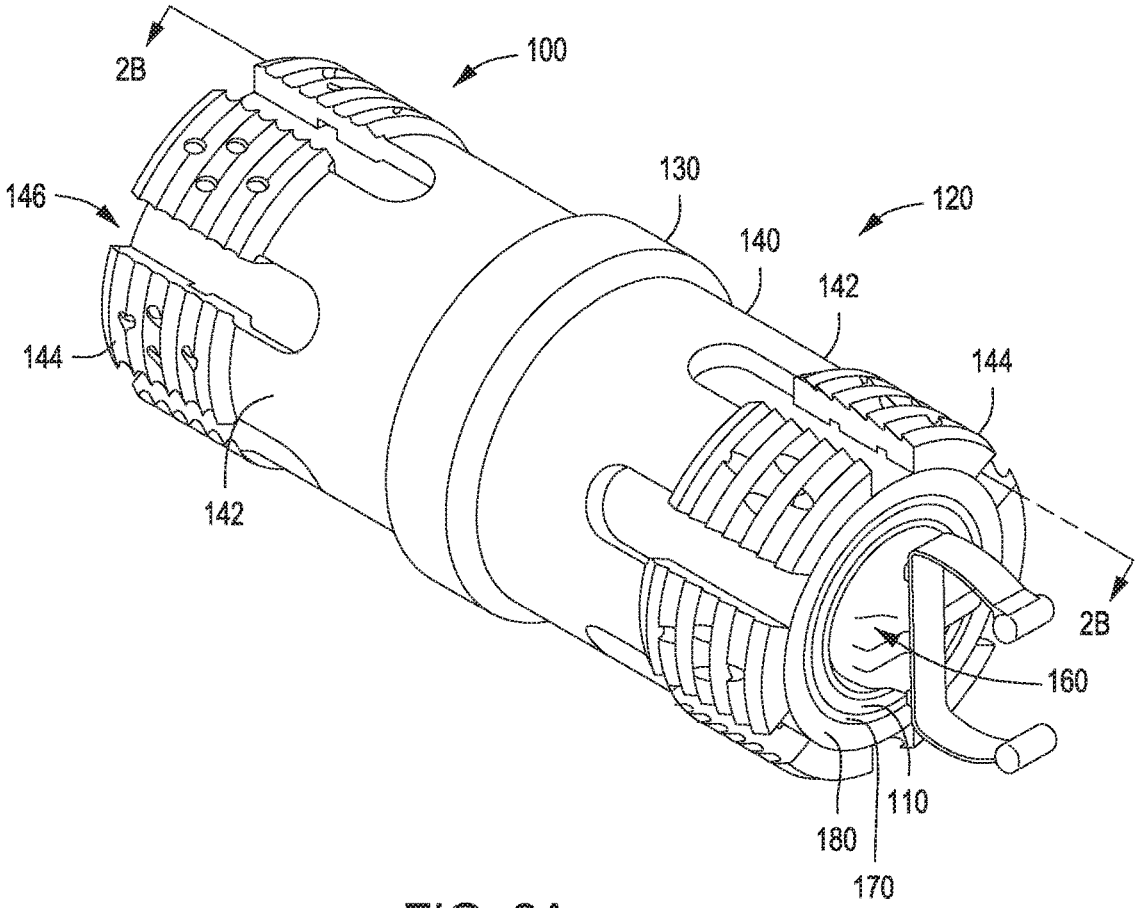
FIGS. 2A and 2B are schematic views of a valve system with a frustoconical mandrel that can be positioned into a casing, according to one or more embodiments.
Figure 2B:
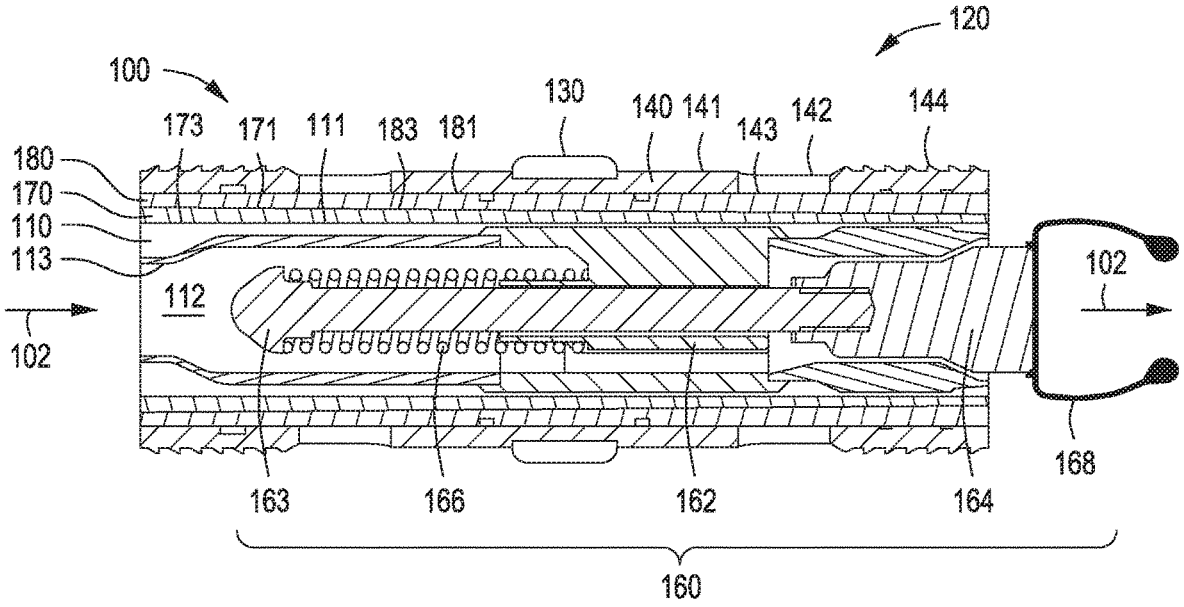

FIGS. 2A and 2B are schematic views of a valve system 100 with a frustoconical mandrel that can be positioned into a casing that is used in a downhole environment, according to one or more embodiments. The valve system 100 is insertable into the casing or pipe above ground and subsequently, the casing containing the installed valve system 100 is placed into a downhole environment, such as a borehole, a well, and/or a subterranean formation. Alternatively, the valve system 100 can be inserted into and attached inside the casing or pipe that is already positioned in a downhole environment.

The valve system 100 includes a tool mandrel 110, a setting system 120, and a check valve assembly 160. As depicted in FIG. 2B, the tool mandrel 110 includes an outside surface 111 and an inside surface 113. The inside surface 113 defines a passageway 112 extending or otherwise passing through the tool mandrel 110. The check valve assembly 160 is coupled to the tool mandrel 110 and operable to provide a fluid flow 102 in a primary direction (depicted by arrows in FIG. 2B) through the passageway 112 and to prohibit the fluid flow 102 in a secondary direction (not shown) through the passageway 112 opposite of the primary direction. The check valve assembly 160 includes a valve body 162, a valve stem 163, a plunger 164, an actuator 166 (e.g., spring), and an engagement member 168. Although the valve system 100 is depicted containing the check valve assembly 160, other types of valves, such as a flapper valve, can substituted for the check valve assembly 160.

As shown in FIG. 2B, fluid flowing along the path of the fluid flow 102 in the primary direction exerts sufficient pressure against the plunger 164 to overcome a force pressing the plunger 164 against the valve body 162. The force pressing the plunger 164 against the valve body 162 includes the actuator 166, as well as fluid pressure from outside of the casing produced from a flowing along a path in the secondary direction opposite of the fluid flow 102 in the primary direction. Whenever the pressure from inside the casing is less than the pressure outside of the casing, the actuator 166 and the outside pressure pushes the plunger 164 into sealing engagement with the valve body 162 therefore prohibiting fluid from flowing along the secondary direction.

The setting system 120 includes a slip collar 140, an inner setting mandrel 170, and an outer setting mandrel 180. The tool mandrel 110 containing the check valve assembly 160 is inserted into the setting system 120 in order to activate the locking mechanism, as further described and discussed below. As depicted in FIG. 2B, the setting system 120 is positioned on and over the tool mandrel 110.

The inner setting mandrel 170 includes a frustoconical outer surface 171 and a cylindrical inner surface 173. The inner setting mandrel 170 is located on and around at least a portion of the tool mandrel 110, such that the cylindrical inner surface 173 of inner setting mandrel 170 is in contact with and positioned on the outside surface 111 of the tool mandrel 110. The outer setting mandrel 180 includes a cylindrical outer surface 181 and a frustoconical inner surface 183. The outer setting mandrel 180 is located on and around at least a portion of the inner setting mandrel 170, such that the frustoconical inner surface 183 of the outer setting mandrel 180 is in contact with and positioned on the frustoconical outer surface 171 of the inner setting mandrel 170.

The frustoconical outer surface 171 of the inner setting mandrel 170 and the frustoconical inner surface 183 of the outer setting mandrel 180 have angles that slope or taper in opposite directions from each other. As depicted in FIG. 2B, the taper of the frustoconical outer surface 171 extends in the direction of the fluid flow 102 and the taper of the frustoconical inner surface 183 extends in the opposite direction of the fluid flow 102. In another embodiment, not shown in the Figures, the frustoconical outer surface 171 and the frustoconical inner surface 183 have angles that slope or taper in the opposite directions as shown. As such, the taper of the frustoconical outer surface 171 extends in the opposite direction of the fluid flow 102 and the taper of the frustoconical inner surface 183 extends in the same direction of the fluid flow 102. Also, the frustoconical outer surface 171 and the cylindrical inner surface 173 of the inner setting mandrel 170, as well as the cylindrical outer surface 181 and the frustoconical inner surface 183 of the outer setting mandrel 180 have a common central axis that also is common with the tool mandrel 110 and the slip collar 140.

The slip collar 140 includes an outer surface 141 and an inner surface 143. The slip collar 140 is located on and around at least a portion of the outer setting mandrel 180, such that the inner surface 143 of the slip collar 140 is in contact with and positioned on the cylindrical outer surface 181 of the outer setting mandrel 180.

The slip collar 140 includes a first end opposite a second end. The slip collar 140 also includes a plurality of tabs 142. The plurality of tabs 142 includes a first group of tabs 142 located on the first end and a second group of tabs 142 located on the second end. Each tab 142 includes a plurality of gripping elements 144. The slip collar 140 also includes one or more sealing elements 130 located on the slip collar 140. The sealing element 130 is located on the slip collar 140 between the first and send group of tabs 142.

The slip collar 140 is operable to radially move for engaging an inner surface of the casing with the gripping elements 144 and/or the sealing element 130. The slip collar 140 is engaged by axially moving the inner setting mandrel 170 relative to the outer setting mandrel 180 or axially moving the outer setting mandrel 180 relative to the inner setting mandrel 170. The inner setting mandrel 170 relative and the outer setting mandrel 180 can be axially moved by an engagement tool, a setting tool, a hammer, or the like.

Once the inner setting mandrel 170 relative and/or the outer setting mandrel 180 have been axially moved, the valve system 100 is affixed into the casing, such that the valve system 100 in a locked or engaged position. The tool mandrel 110 holds the inner setting mandrel 170 relative and the outer setting mandrel 180 in place which in turn radially push the sealing element 130 against the casing.

Figure 5:
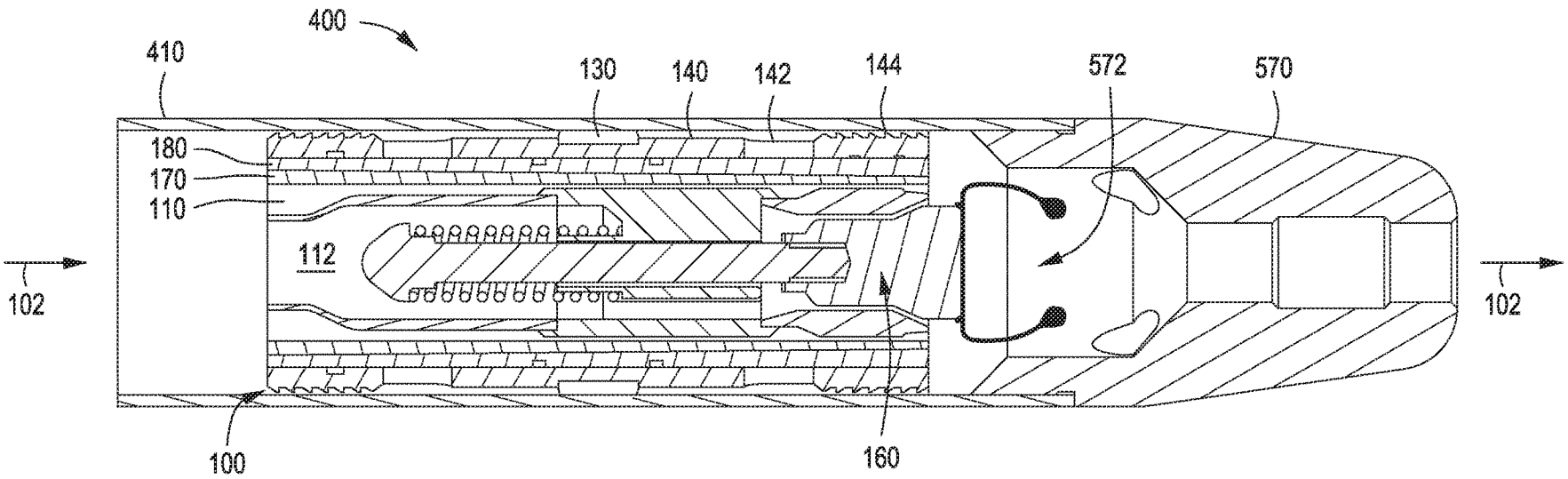
FIG. 5 is a schematic view of a valve system, depicted in FIGS. 2A and 2B, positioned in a casing with a nose, according to one or more embodiments.

The sealing element 130 is located on the outside surface 141 of the slip collar 140. The sealing element 130 can be or include, but is not limited to, one or more O-rings, O-seals, packer elements, or any combination thereof. The sealing element 130 can contain one or more polymers, oligomers, rubbers (natural and/or synthetic), silicones, or any combinations thereof. The sealing element 130 forms a gas-tight seal once in sealing engagement with the inner surface of the casing (as shown in FIG. 5).

The gripping elements 144 can be or include, but are not limited to, one or more teeth, one or more ridges, one or more threads, or one or more slip buttons. The gripping elements 144 extend from the outer surface of the slip collar 140. The gripping elements 144 can extend from slip collar 140 at an angle (as shown in FIG. 2B), or alternative, the gripping elements 144 can extend perpendicular from the slip collar 140 (not shown). The gripping elements 144 are configured to make contact with and grip the inner surface of the casing. Once in contact, the gripping elements 144 produce enough friction against the inner surface of the casing to hold the valve system 100 into place within the casing.

The gripping elements 144 generally contain a material durable enough to withstand the pressures and temperatures experienced downhole in the casing. The gripping elements 144 can contain, but are not limited to, one or more materials that include metal (e.g., cast iron, steel, aluminum, magnesium, or alloys thereof), metal carbide (e.g., tungsten carbide), ceramic, thermoplastic (e.g., phenolic resins or plastic), or any combinations thereof. In one or more examples, the gripping elements 144 are teeth or ridges and contain metal. In other examples, the gripping elements 144 are slip buttons and contain a ceramic. In another embodiment, the gripping elements 144 contain a dissolvable material that can be readily dissolved or deteriorated when exposed to an aqueous fluid, such as a cement or a water-based mud, that is an acidic or alkaline. Exemplary dissolvable materials can be or include, but are not limited to, one or more of aluminum, magnesium, aluminum-magnesium alloy, iron, alloys thereof, degradable polymer, or any combination thereof.

Figure 3A:
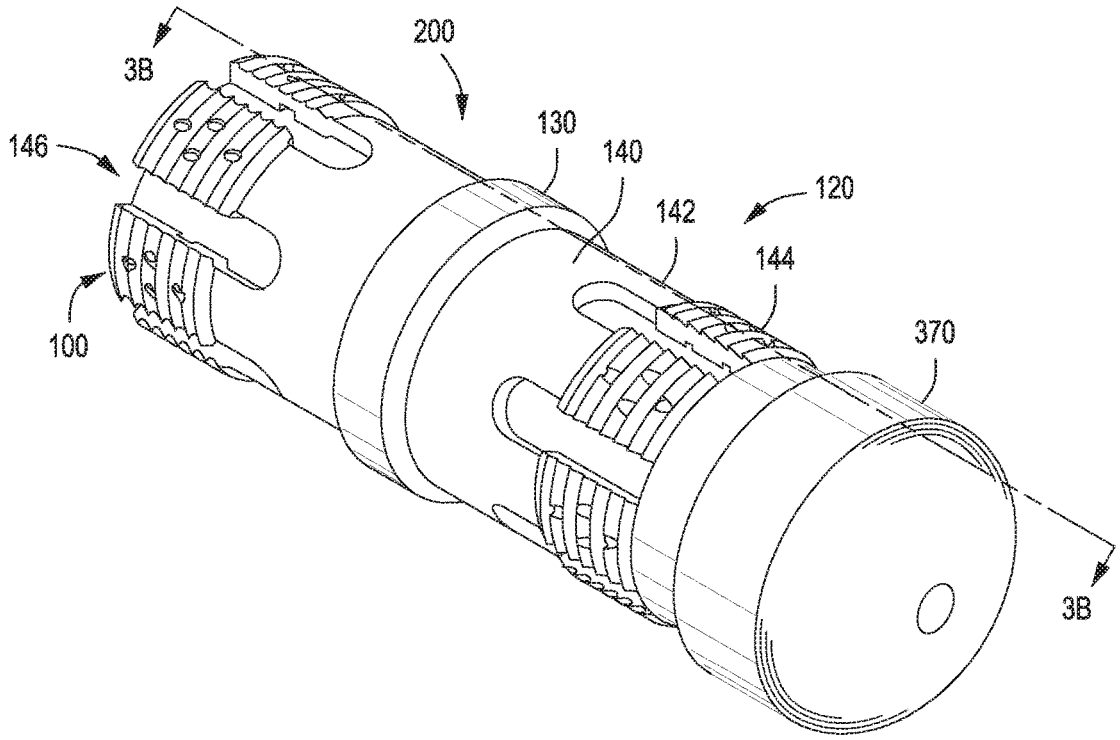
FIGS. 3A and 3B are schematic views of the valve system, depicted in FIGS. 2A and 2B, containing a nose coupled thereto, according to one or more embodiments.
Figure 3B:
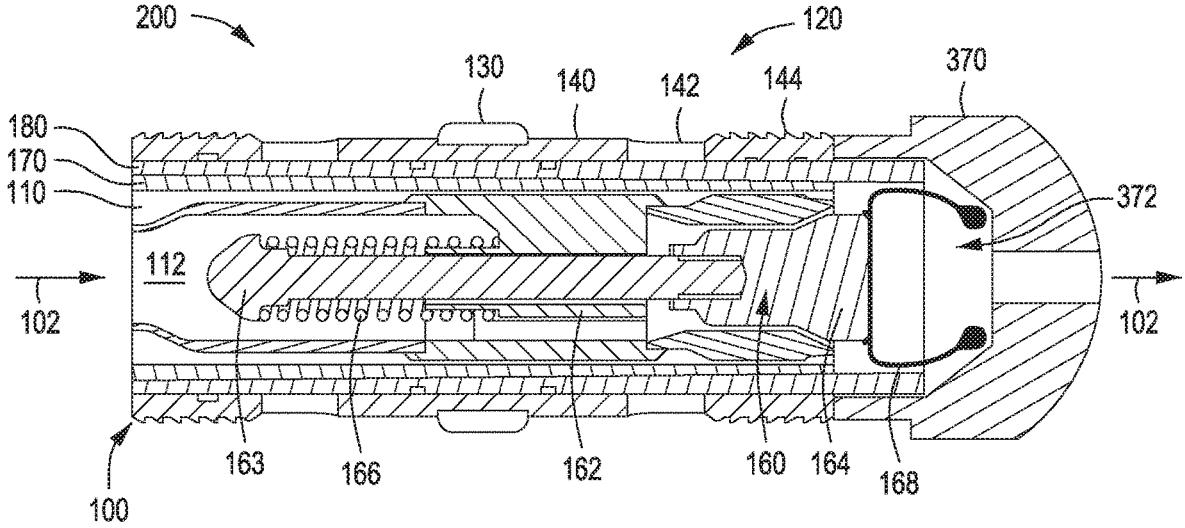

The valve system 100 can be implemented into a variety of floating equipment tools. The valve system 100 can be used with noses, reamers, and other types of tools. As depicted in FIGS. 3A and 3B, a system 200 includes the valve system 100 in a locked or engaged position and including a nose 370 coupled thereto, according to one or more embodiments. A passageway 372 extends or passes through the nose 370 and is in fluid communication with the passageway 112 passing through the valve system 100.

Figure 4A:
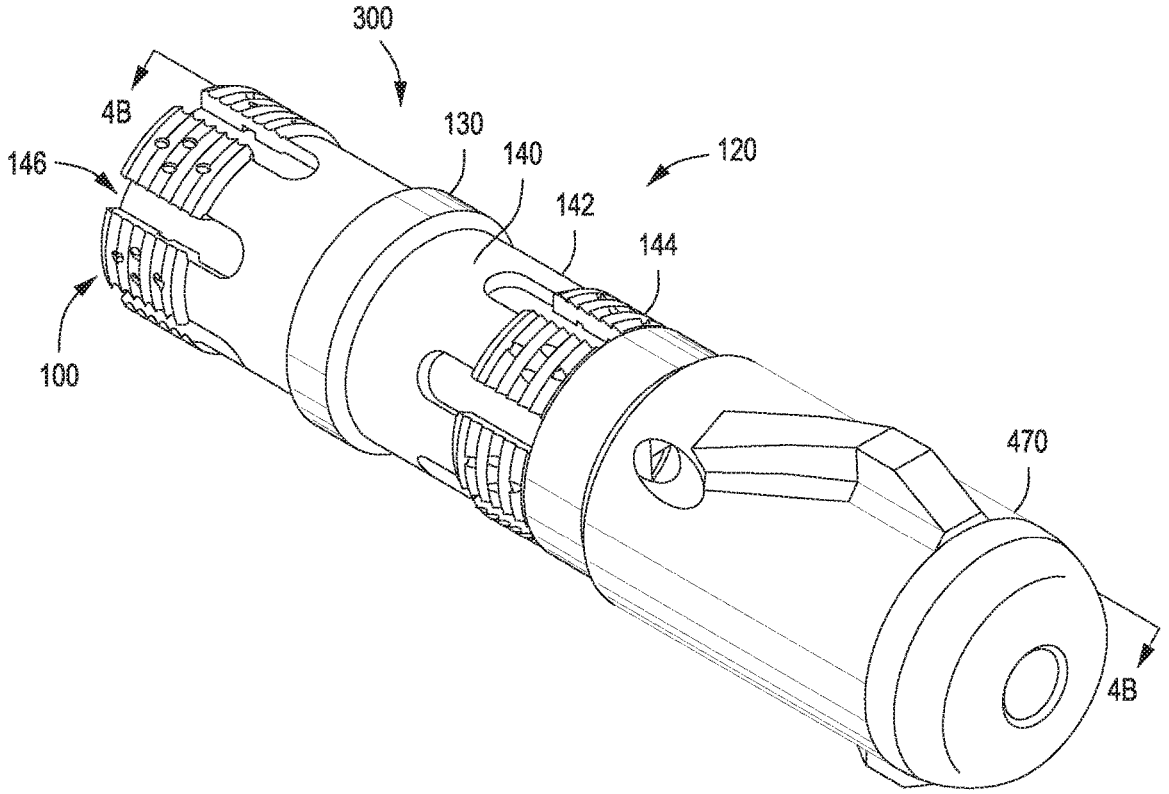
FIGS. 4A and 4B are schematic views of the valve system, depicted in FIGS. 2A and 2B, containing a reamer coupled thereto, according to one or more embodiments.
Figure 4B:
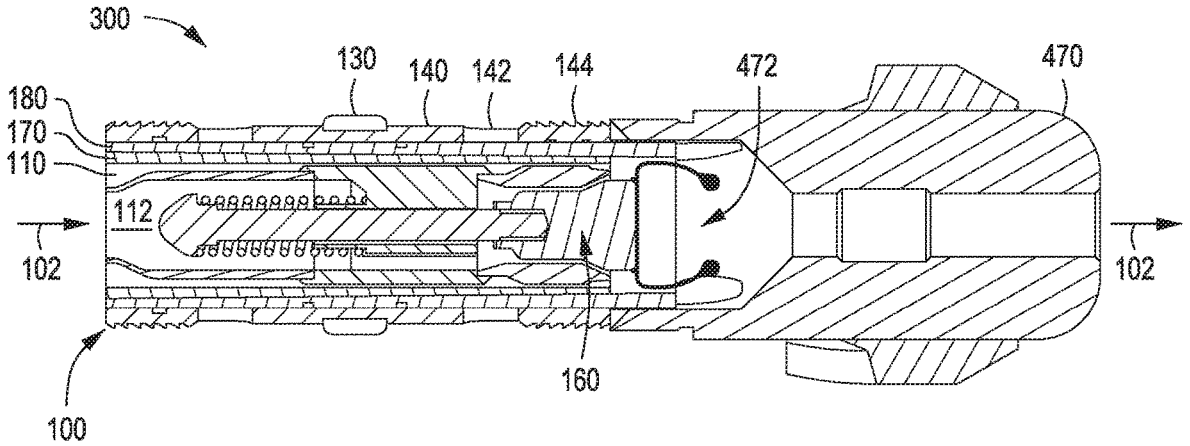

As depicted in FIGS. 4A and 4B, a system 300 includes the valve system 100 in a locked or engaged position and including a reamer 470 coupled thereto, according to one or more embodiments. A passageway 472 extends or passes through the reamer 470 and is in fluid communication with the passageway 112 passing through the valve system 100.

As depicted in FIG. 5, a system 400 includes the valve system 100 positioned within the casing 410 having a nose 570, according to one or more embodiments. A passageway 572 extends or passes through the nose 570 and is in fluid communication with the passageway 112 passing through the valve system 100.

In one or more embodiment, a method for installing a valve system (e.g., valve system 100 or other valve systems) into a casing or a pipe used in a downhole environment is provided. The method can include inserting or positioning the valve system into the casing and affixing the valve system to an inner surface of the casing by axially moving an inner setting mandrel relative to an outer setting mandrel or axially moving the outer setting mandrel relative to the inner setting mandrel.

The valve system includes a tool mandrel, a check valve assembly, and a setting system. The setting system includes the inner setting mandrel, the outer setting mandrel, and a slip collar. The inner setting mandrel is located on and around the tool mandrel and includes a cylindrical inner surface and a frustoconical outer surface. The outer setting mandrel is located on and around the inner setting mandrel and includes a frustoconical inner surface and a cylindrical outer surface. The slip collar is located on the outer setting mandrel. The slip collar includes a plurality of tabs and each tab includes a plurality of gripping elements.

The method includes affixing the valve system to the inner surface of the casing by radially moving the slip collar to engage the inner surface of the casing with the gripping elements and the sealing element. The valve system can be affixed, set, coupled, or otherwise attached to the inner surface of the casing when the casing is above ground, prior to placing the casing into a downhole environment. The method can also include placing or positioning the casing containing the affixed, connected, or otherwise attached valve system into a borehole, a well, a subterranean formation, or other downhole environment.

During oil and gas production, the process of cementing a casing into the wellbore of an oil or gas well includes several steps. A string of casings is run in the wellbore to the desired depth. Then, a cement slurry is pumped from outside of the wellbore (e.g., ground surface) and into the casing to fill an annulus between the casing and the wellbore wall to a desired height. A displacement medium, such as a drilling or circulation fluid, is pumped behind the cement slurry in order to push the cement slurry to exit the inside of the casing and enter the annulus. The cement slurry is typically separated from the circulation fluid by at least one cementing plug. Due to the difference in specific gravity between the circulating fluid and the cement slurry, the heavier cement slurry initially drops inside the casing without being pumped by hydrostatic pressure. After the height of cement slurry column outside the casing in the annulus equals the height of the cement slurry column inside the casing, hydrostatic pressure must be exerted on the displacement fluid to force the rest of cement slurry out of the casing and into the annulus. After the desired amount of cement slurry has been pumped into the annulus, it is desirable to prevent the backflow of cement slurry into the casing until the cement slurry sets and hardens. This backflow is produced by the difference in specific gravity of the heavier cement and the lighter displacement fluid.

In one or more embodiments, a method of preventing the backflow of cement slurry involves placing a check valve, as discussed and described herein, in the lower end of the casing string to prevent the backflow of the cement slurry and/or other fluids into the casing. The check valve is generally located on a conventional casing string near or at the bottom of the casing string. Then, the cement slurry is pumped through the check valve and into the borehole. As the casing is cemented into place in the downhole or subterranean environment, the check valve prevents fluid flow into the casing from the well or formation. Since the check valve maintains the cement and/or fluid from entering the casing, the casing has more buoyancy and does not need to be supported as much as if the end of the casing was open to backflow. Cement is then pumped down the inside of the casing, out of the check valve, and back up the annulus between the casing and the wellbore wall where the cement is allowed to cure.

In addition to the embodiments described above, embodiments of the present disclosure further relate to one or more of the following paragraphs:

1. A valve system for inserting into a casing within a downhole environment, comprising: a tool mandrel comprising a passageway therethrough; a check valve assembly coupled to the tool mandrel and operable to provide a fluid flow only in a primary direction through the passageway; and a setting system comprising: an inner setting mandrel located around at least a portion of the tool mandrel, wherein the inner setting mandrel comprises a frustoconical outer surface; an outer setting mandrel located around at least a portion of the inner setting mandrel, wherein the outer setting mandrel comprises a frustoconical inner surface; and a slip collar located around at least a portion of the outer setting mandrel, wherein the slip collar comprises a plurality of tabs and each tab comprises gripping elements.

2. A casing string for inserting into a downhole environment, comprising: a valve system insertable into the casing string and comprising: a tool mandrel comprising a passageway therethrough; a check valve assembly coupled to the tool mandrel and operable to provide a fluid flow only in a primary direction through the passageway; and a setting system comprising: an inner setting mandrel located around at least a portion of the tool mandrel, wherein the inner setting mandrel comprises a frustoconical outer surface; an outer setting mandrel located around at least a portion of the inner setting mandrel, wherein the outer setting mandrel comprises a frustoconical inner surface; a slip collar located around at least a portion of the outer setting mandrel, wherein the slip collar comprises a plurality of tabs and each tab comprises gripping elements; a sealing element located on the slip collar; and wherein the slip collar is operable to radially move to engage an inner surface of the casing with the gripping elements and the sealing element by axially moving the inner setting mandrel relative to the outer setting mandrel or axially moving the outer setting mandrel relative to the inner setting mandrel.

3. The valve system of paragraph 1 or 2, wherein the slip collar is operable to radially move and engage an inner surface of the casing with the gripping elements by axially moving the inner setting mandrel relative to the outer setting mandrel or axially moving the outer setting mandrel relative to the inner setting mandrel.

4. The valve system according to any one of paragraphs 1-3, wherein the setting system further comprises a sealing element located on the slip collar and operable to provide sealing engagement with an inner surface of the casing.

5. The valve system of paragraph 4, wherein the slip collar is operable to radially move and engage an inner surface of the casing with the sealing element by axially moving the inner setting mandrel relative to the outer setting mandrel or axially moving the outer setting mandrel relative to the inner setting mandrel.

6. The valve system according to any one of paragraphs 1-5, wherein the frustoconical outer surface of the inner setting mandrel is in contact with the frustoconical inner surface of the outer setting mandrel.

7. The valve system according to any one of paragraphs 1-6, wherein the frustoconical outer surface of the inner setting mandrel and the frustoconical inner surface of the outer setting mandrel have a common central axis and slope in opposite directions from each other.

8. The valve system according to any one of paragraphs 1-7, wherein the slip collar comprises a first end opposite a second end, and wherein the plurality of tabs comprises a first group of tabs located on the first end and a second group of tabs located on the second end.

9. The valve system according to any one of paragraphs 1-8, wherein the gripping elements comprise teeth, threads, or slip buttons for gripping the inner surface of the casing.

10. The valve system of paragraph 9, wherein the gripping elements comprise a material selected from the group consisting of metal, metal carbide, ceramic, thermoplastic, and combinations thereof.

11. The valve system of paragraph 9, wherein the gripping elements comprise teeth, ridges, or threads that comprise metal.

12. A method for installing a valve system into a casing used in a downhole environment, comprising: inserting the valve system into the casing, wherein the valve system comprises: a tool mandrel comprising a passageway therethrough; a check valve assembly coupled to the tool mandrel and operable to provide a fluid flow only in a primary direction through the passageway; and a setting system comprising: an inner setting mandrel located around at least a portion of the tool mandrel, wherein the inner setting mandrel comprises a frustoconical outer surface; an outer setting mandrel located around at least a portion of the inner setting mandrel, wherein the outer setting mandrel comprises a frustoconical inner surface; and a slip collar located around at least a portion of the outer setting mandrel, wherein the slip collar comprises a plurality of tabs and each tab comprises gripping elements; and affixing the valve system to an inner surface of the casing by axially moving the inner setting mandrel relative to the outer setting mandrel or axially moving the outer setting mandrel relative to the inner setting mandrel to expand the slip collar radially outward into gripping engagement with the inner surface of the casing.

13. The method of paragraph 12, wherein affixing the valve system to the inner surface of the casing further comprises radially moving the slip collar to engage the inner surface of the casing with the gripping elements and the sealing element.

14. The method of paragraph 12 or 13, wherein affixing the valve system to the inner surface of the casing is conducted above ground prior to placing the casing into the downhole environment.

15. The method according to any one of paragraphs 12-14, further comprising placing the casing containing the connected valve system into a borehole, a well, or a subterranean formation.

16. The method according to any one of paragraphs 12-15, wherein the frustoconical outer surface of the inner setting mandrel is in contact with the frustoconical inner surface of the outer setting mandrel.

17. The method according to any one of paragraphs 12-16, wherein the frustoconical outer surface of the inner setting mandrel and the frustoconical inner surface of the outer setting mandrel have a common central axis and slope in opposite directions from each other.

18. The method according to any one of paragraphs 12-17, wherein the slip collar comprises a first end opposite a second end, and wherein the plurality of tabs comprises a first group of tabs disposed on the first end and a second group of tabs disposed on the second end.

19. The method according to any one of paragraphs 12-18, wherein the gripping elements comprise teeth, threads, or slip buttons for gripping the inner surface of the casing.

20. The method of paragraph 19, wherein the gripping elements comprise a material selected from the group consisting of metal, metal carbide, ceramic, thermoplastic, and combinations thereof.

21. The method of paragraph 19, wherein the gripping elements comprise teeth or threads that comprise metal.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

In the following discussion and in the claims, the articles "a," "an," and "the" are intended to mean that there are one or more of the elements. The terms "including," "comprising," and "having" and variations thereof are used in an open-ended fashion, and thus should be interpreted to mean "including, but not limited to . . . ." Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A valve system for inserting into a casing within a downhole environment, comprising:
- a tool mandrel comprising a passageway therethrough;
- a check valve assembly coupled to the tool mandrel and operable to provide a fluid flow only in a primary direction through the passageway; and
- a setting system comprising:
  - an inner setting mandrel located around at least a portion of the tool mandrel, wherein the inner setting mandrel comprises a frustoconical outer surface;
  - an outer setting mandrel located around at least a portion of the inner setting mandrel, wherein the outer setting mandrel comprises a frustoconical inner surface;
  - a slip collar located around at least a portion of the outer setting mandrel, wherein the slip collar comprises a plurality of tabs and each tab comprises gripping elements; and
  - a sealing element located on the slip collar and operable to provide sealing engagement with an inner surface of the casing.

2. The valve system of claim 1, wherein the slip collar is operable to radially move and engage the inner surface of the casing with the gripping elements by axially moving the inner setting mandrel relative to the outer setting mandrel or axially moving the outer setting mandrel relative to the inner setting mandrel.

3. The valve system of claim 1, wherein the slip collar is operable to radially move and engage an inner surface of the casing with the sealing element by axially moving the inner setting mandrel relative to the outer setting mandrel or axially moving the outer setting mandrel relative to the inner setting mandrel.

4. The valve system of claim 1, wherein the frustoconical outer surface of the inner setting mandrel is in contact with the frustoconical inner surface of the outer setting mandrel.

5. The valve system of claim 1, wherein the frustoconical outer surface of the inner setting mandrel and the frustoconical inner surface of the outer setting mandrel have a common central axis and slope in opposite directions from each other.

6. The valve system of claim 1, wherein the slip collar comprises a first end opposite a second end, and wherein the plurality of tabs comprises a first group of tabs located on the first end and a second group of tabs located on the second end.

7. The valve system of claim 1, wherein the gripping elements comprise teeth, threads, or slip buttons for gripping the inner surface of the casing.

8. The valve system of claim 7, wherein the gripping elements comprise a material selected from the group consisting of metal, metal carbide, ceramic, thermoplastic, and combinations thereof.

9. The valve system of claim 7, wherein the gripping elements comprise teeth, ridges, or threads that comprise metal.

10. A casing string for inserting into a downhole environment, comprising:
- a valve system insertable into the casing string and comprising:
  - a tool mandrel comprising a passageway therethrough;
  - a check valve assembly coupled to the tool mandrel and operable to provide a fluid flow only in a primary direction through the passageway; and
  - a setting system comprising:
    - an inner setting mandrel located around at least a portion of the tool mandrel, wherein the inner setting mandrel comprises a frustoconical outer surface;
    - an outer setting mandrel located around at least a portion of the inner setting mandrel, wherein the outer setting mandrel comprises a frustoconical inner surface;
    - a slip collar located around at least a portion of the outer setting mandrel, wherein the slip collar comprises a plurality of tabs and each tab comprises gripping elements;
    - a sealing element located on the slip collar; and
    - wherein the slip collar is operable to radially move to engage an inner surface of the casing with the gripping elements and the sealing element by axially moving the inner setting mandrel relative to the outer setting mandrel or axially moving the outer setting mandrel relative to the inner setting mandrel.

11. A method for installing a valve system into a casing used in a downhole environment, comprising:
- inserting the valve system into the casing, wherein the valve system comprises:
  - a tool mandrel comprising a passageway therethrough;
  - a check valve assembly coupled to the tool mandrel and operable to provide a fluid flow only in a primary direction through the passageway; and
  - a setting system comprising:
    - an inner setting mandrel located around at least a portion of the tool mandrel, wherein the inner setting mandrel comprises a frustoconical outer surface;
    - an outer setting mandrel located around at least a portion of the inner setting mandrel, wherein the outer setting mandrel comprises a frustoconical inner surface;
    - a slip collar located around at least a portion of the outer setting mandrel, wherein the slip collar comprises a plurality of tabs and each tab comprises gripping elements; and
    - a sealing element located on the slip collar and operable to provide sealing engagement with an inner surface of the casing; and
- affixing the valve system to the inner surface of the casing by axially moving the inner setting mandrel relative to the outer setting mandrel or axially moving the outer setting mandrel relative to the inner setting mandrel to expand the slip collar radially outward into gripping engagement with the inner surface of the casing.

12. The method of claim 11, wherein affixing the valve system to the inner surface of the casing further comprises radially moving the slip collar to engage the inner surface of the casing with the gripping elements and the sealing element.

13. The method of claim 11, wherein affixing the valve system to the inner surface of the casing is conducted above ground prior to placing the casing into the downhole environment.

14. The method of claim 11, further comprising placing the casing containing the connected valve system into a borehole, a well, or a subterranean formation.

15. The method of claim 11, wherein the frustoconical outer surface of the inner setting mandrel is in contact with the frustoconical inner surface of the outer setting mandrel.

16. The method of claim 11, wherein the frustoconical outer surface of the inner setting mandrel and the frustoconical inner surface of the outer setting mandrel have a common central axis and slope in opposite directions from each other.

17. The method of claim 11, wherein the slip collar comprises a first end opposite a second end, and wherein the plurality of tabs comprises a first group of tabs disposed on the first end and a second group of tabs disposed on the second end.

18. The method of claim 11, wherein the gripping elements comprise teeth, threads, or slip buttons for gripping the inner surface of the casing.

19. The method of claim 18, wherein the gripping elements comprise a material selected from the group consisting of metal, metal carbide, ceramic, thermoplastic, and combinations thereof.

* * * * *